US008955241B1

(12) United States Patent
Wolf

(10) Patent No.: US 8,955,241 B1
(45) Date of Patent: Feb. 17, 2015

(54) BUSINESS CARD AND PRE-MOISTENED WIPE

(71) Applicant: Walter Daniel Wolf, Emerson, NJ (US)

(72) Inventor: Walter Daniel Wolf, Emerson, NJ (US)

(73) Assignee: Walter D. Wolf, Emerson, NJ (US)

( * ) Notice: Subject to any disclaimer, the term of this patent is extended or adjusted under 35 U.S.C. 154(b) by 0 days.

(21) Appl. No.: 14/146,707

(22) Filed: Jan. 2, 2014

(51) Int. Cl.
*G09F 1/00* (2006.01)

(52) U.S. Cl.
USPC ..... 40/124.06

(58) Field of Classification Search
CPC ..... G09F 1/00
USPC ..... 40/124.06
See application file for complete search history.

(56) References Cited

U.S. PATENT DOCUMENTS

| | | | | |
|---|---|---|---|---|
| 4,839,976 | A * | 6/1989 | Kyler | 40/124.06 |
| 7,500,604 | B2 * | 3/2009 | Holme | 235/380 |
| 2007/0266602 | A1 * | 11/2007 | Daghighian | 40/492 |
| 2008/0222929 | A1 * | 9/2008 | Sawin et al. | 40/124.06 |
| 2009/0071046 | A1 * | 3/2009 | Hermanson et al. | 40/409 |

* cited by examiner

*Primary Examiner* — Gary Hoge
(74) *Attorney, Agent, or Firm* — Richard M. Goldberg

(57) ABSTRACT

Sani Card, the professional business card that combines a standard size business card with a pre-moistened, self-contained hand, eye glass or computer screen cleaning wipe all in a clear plastic wrap sealed at both ends. This card is a marketing/promotional product designed to separate the card holder from his competition. It is a considerate, thoughtful and value add gesture in anticipation of future business and causes the recipient to remember who the card holder is, what he does and what company he represents. The main components are a standard size business card, pre-moistened wipe and clear plastic wrapper.

1 Claim, 3 Drawing Sheets

Combines Fig1, Fig 3 and Fig 4.

Card Density - 350 g/m²
Card Weight - 45 kg
Card Thickness - 12 pts or better

Sealed in plastic, self-contained, opaque wrapper.

Clear plastic wrapper.

Fig 5. Combines Fig1, Fig 3 and Fig 4.
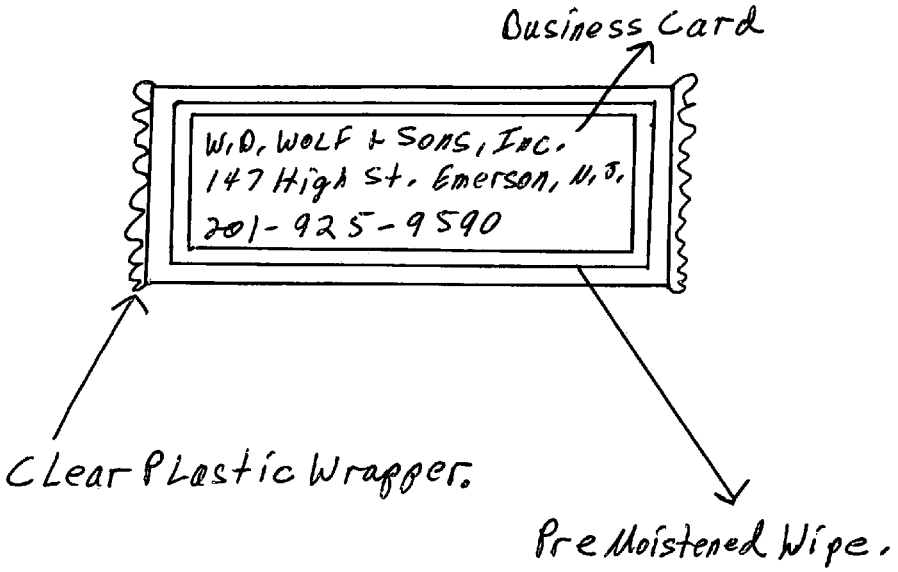

BUSINESS CARD AND PRE-MOISTENED WIPE

CROSS REFERENCE TO RELATED APPLICATIONS

This application is a continuation-in-part of Ser. No. 14/146,707, filed Jan. 2, 2014 and incorporates a corrected abstract, claims and substitute specification. Please note that NO NEW information or material has been added to the abstract, claims or specification. The substitute specification has been put in the format requested in your letter of Mar. 21, 2014. I have also included a drawings page to be substituted in lieu of photographs of the invention which were submitted with my original application. I will abandon the photographs since I was advised that your office prefers pen drawings over photographs. Lastly, I have included my Inventors oath or declaration which was not included in my original application.

BACKGROUND OF THE INVENTION

This invention relates to the development of a business marketing/promotional product designed to separate the card holder from his competition. It offers a useful cleaning wipe (eye glass, computer screen, hand wipe) combined with the persons business card and heat sealed in a clear plastic wrapper ready to be handed out to prospective customers.

It is the process of combining the business card with the self-contained, pre-moistened cleaning wipe in a clear plastic wrapper that creates the marketing/promotional Sani Card product.

SUMMARY OF THE INVENTION

The present invention evolved over 20 years of direct sales experience by me. This product affords the card holder the ability to separate himself from his competition by providing the card recipient with a thoughtful, value add and considerate gesture right from the beginning thus causing the recipient to take notice of the card holder's name, company and product/service.

This promotional/marketing product combines a standard size paper business card with a self-contained, pre-moistened cleaning wipe (computer screen, eye glass, hand) all combined together in a clear plastic wrapper. The Sani Card's appearance and content immediately distinguish the card holder from all other competitors and creates a distinctive competitive advantage.

BRIEF DESCRIPTION OF THE DRAWINGS

FIG. 5 shows FIG. 1 thru FIG. 4 coming together to make the Sani Card. The three components that make-up the Sani Card include the standard size business card, self-contained cleaning wipe and clear plastic wrapper. Card dimensions are as follows: standard size paper business card-1 and ⅞ inches wide by 3 and ⅜ inches long. The card density, based on industry standards is a minimum of 350 g/m2; card weight is a minimum of 45 kg (100 lbs) and card thickness is at least 12 pts or better; all based on industry standards. The front of the business card has the card holder's company information/design graphics as requested by the card purchaser. Back of business card is plain with no writing or graphics.

Figure 1:
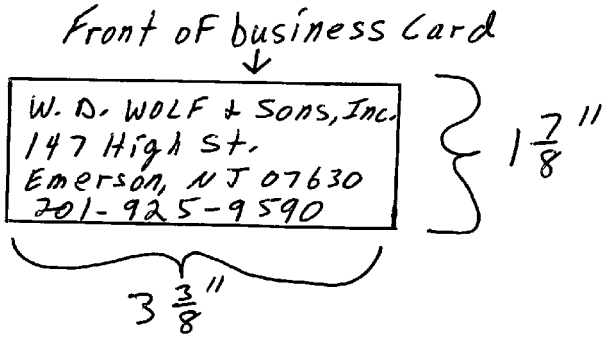
FIG. 1 shows the front of the business card.
Figure 2:
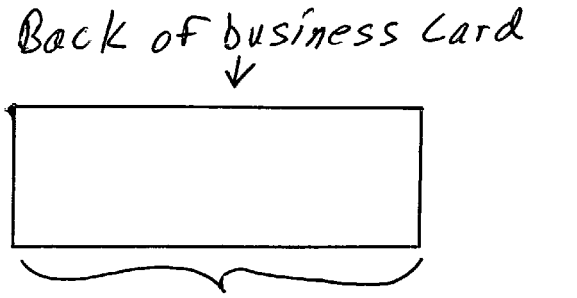
FIG. 2 shows the back of the business card.
Figure 3:
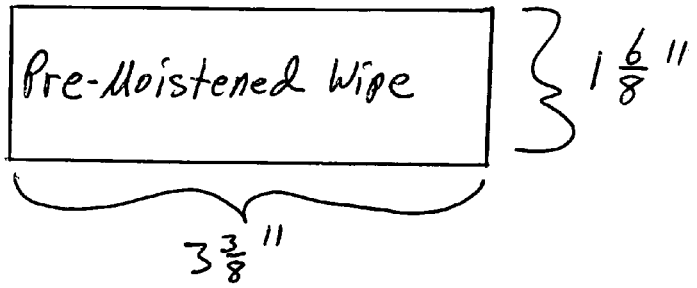
FIG. 3 shows the pre-moistened, self-contained cleaning wipe.
Figure 4:
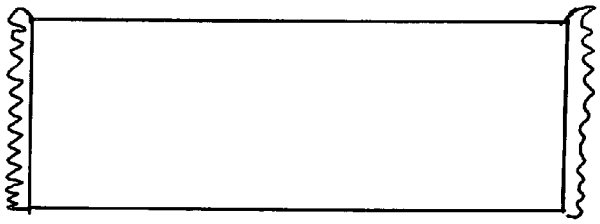
FIG. 4 shows the clear plastic wrapper.

The dimensions of the pre-moistened wipe are 1 and ⅝ inches wide by 3 and ⅜ inches long and sealed in a plastic, self-contained, opaque wrapper. The business card and the self-contained, pre-moistened wipe are then heat sealed at both ends in a clear, plastic wrapper.

The pre-moistened wipe is made of paper, fiber cloth and then applied with a mild detergent (amphoteric surfactants), preservative (propyl paraben) and fragrance.

DETAILED DESCRIPTION OF THE FIRST EMBODIMENT

In the above-mentioned patent application, a Sani Card is a marketing/promotional product comprised of a standard size business card; a pre-moistened, self-contained cleaning wipe and a clear plastic wrapper. All three components are then combined and are ready to be used. It is designed to separate the card holder from his competition by providing a useful cleaning wipe product that the card recipient can use and also shows a spirit of thoughtfulness and consideration for the other person in anticipation of working together.

As can be seen in the attached drawings section; the three Sani Card components are comprised of the business card, an eye glass, computer screen or general purpose cleaning wipe cut to a size just smaller than the business card, is self-contained and all joined together in a clear plastic wrapper that is heat sealed at both ends.

The invention claimed is:

1. A method of marketing a business card with a self-contained, pre-moistened cleaning wipe, comprising the steps of:

Providing a business card made of paper and having contact information printed hereon;

Sealing a pre-moistened cleaning wipe in a self-contained opaque wrapper the same size as the business card;

Placing the business card and the cleaning wipe together in a clear plastic wrap having at least two ends; and Sealing both ends of the clear plastic wrap.

* * * * *